US006808596B1

(12) United States Patent
Dahllof et al.

(10) Patent No.: US 6,808,596 B1
(45) Date of Patent: Oct. 26, 2004

(54) SYSTEM FOR THE OXYGEN DELIGNIFICATION OF PULP CONSISTING OF LIGNOCELLULOSE-CONTAINING MATERIAL

(75) Inventors: Hakan Dahllof, Edsvalla (SE); Martin Ragnar, Karlstad (SE)

(73) Assignee: Kvaerner Pulping AB, Karlstad (SE)

( * ) Notice: Subject to any disclaimer, the term of this patent is extended or adjusted under 35 U.S.C. 154(b) by 0 days.

(21) Appl. No.: 10/030,637

(22) PCT Filed: Jul. 6, 2000

(86) PCT No.: PCT/SE00/01453

§ 371 (c)(1),
(2), (4) Date: May 19, 2003

(87) PCT Pub. No.: WO01/02641

PCT Pub. Date: Jan. 11, 2001

(30) Foreign Application Priority Data

Jul. 6, 1999 (SE) ..... 9902586

(51) Int. Cl.[7] ..... D21C 9/147

(52) U.S. Cl. ..... 162/65; 162/17; 162/19; 162/237

(58) Field of Search ..... 162/63, 65, 17, 162/237, 19

(56) References Cited

U.S. PATENT DOCUMENTS 1,980,390 A * 11/1934 Dreyfus et al. ..... 162/231
2,028,419 A * 1/1936 Sperry ..... 162/231
2,723,194 A * 11/1955 Birdseye ..... 162/231
2,771,361 A * 11/1956 Birdseye et al. ..... 162/231
4,198,266 A * 4/1980 Kirk et al. ..... 162/29
4,259,150 A * 3/1981 Prough ..... 162/40
4,363,697 A * 12/1982 Markham et al. ..... 162/19
4,431,480 A * 2/1984 Markham et al. ..... 162/19
4,689,117 A * 8/1987 Villavicencio ..... 162/19
5,277,760 A * 1/1994 Fongen ..... 162/6
5,916,415 A * 6/1999 Miller ..... 162/65
6,162,324 A * 12/2000 Miller ..... 162/57
6,221,208 B1 * 4/2001 Damberg ..... 162/52

FOREIGN PATENT DOCUMENTS

WO WO 97/15715 5/1997

* cited by examiner

*Primary Examiner*—Peter Chin
(74) *Attorney, Agent, or Firm*—Rolf Fasth; Fasth Law Offices

(57) ABSTRACT

The system is for the oxygen delignification, in at least two reaction stages, of pulp that consists of lignocellulose-containing material having a mean concentration of 8%–18% pulp consistency. The oxygen delignification takes place in a first reaction stage that has a substantially constant low pressure during the whole delignification process. The second delignification stage has a substantially higher pressure and temperature and a longer dwell time. Readily delignifiable constituents in the pulp may react without the pulp being negatively affected so that the delignification process provides a very high degree of selectivity and an improved yield.

20 Claims, 3 Drawing Sheets

Figure 1:
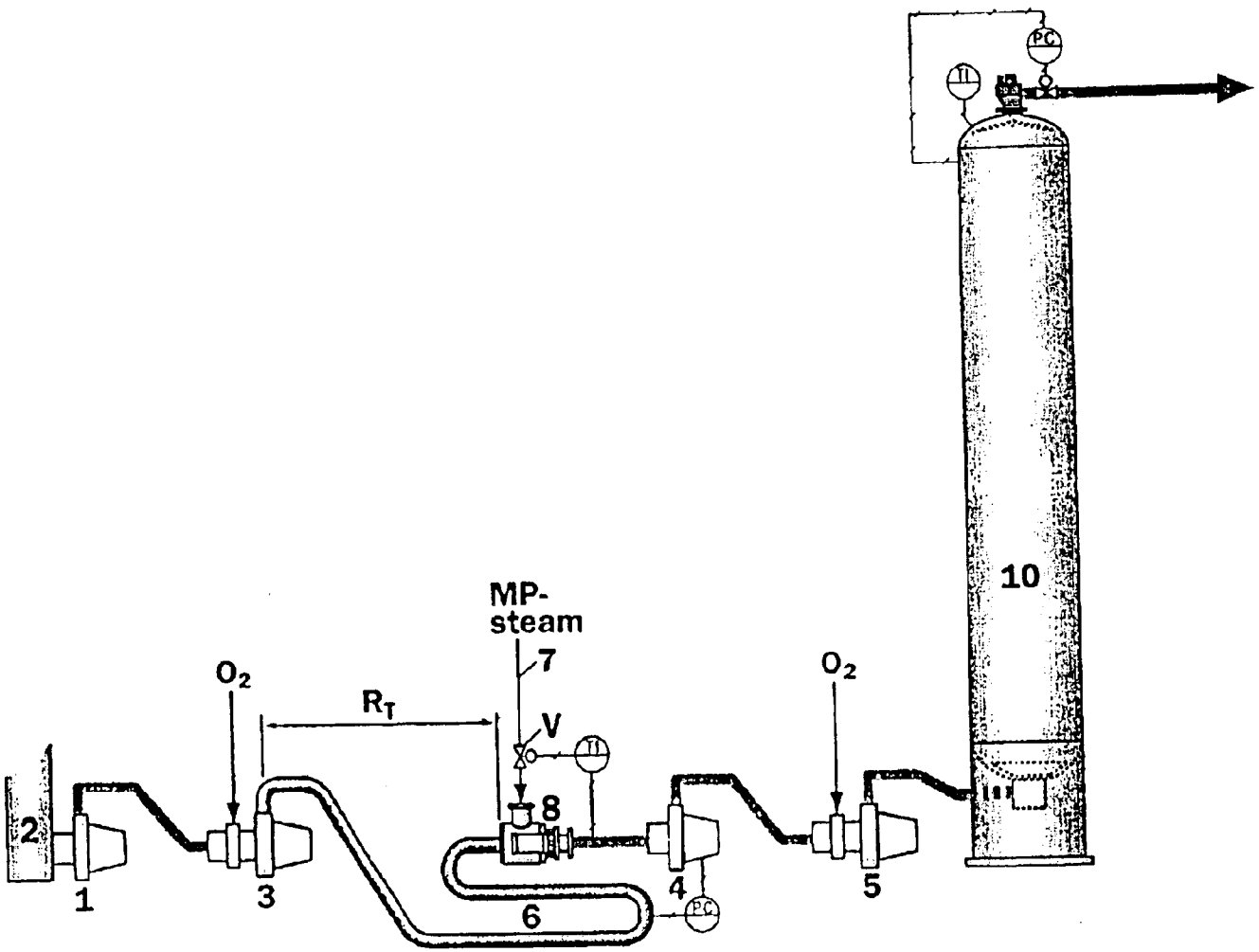

SYSTEM FOR THE OXYGEN DELIGNIFICATION OF PULP CONSISTING OF LIGNOCELLULOSE-CONTAINING MATERIAL

The present invention relates to a system for oxygen delignification in accordance with the preamble to Patent claim 1.

STATE OF THE ART

A number of different processes for oxygen delignification have been disclosed.

U.S. Pat. No. 4,259,150 presents a system involving a multistage oxygen bleaching in which the pulp is, in each stage, firstly mixed to a lower consistency with $O_2$, water and NaOH, followed by a thickening back to the consistency level which the pulp had up until the stage in question. The aim is to achieve an economical, chlorine-free bleaching with high yield. At the same time, the kappa number can be lowered, by means of repeated stages, from 70 down to 15, or even to less than 15.

SE,C,467.582 presents an improved system for the oxygen bleaching of pulp of medium consistency. By means of the temperature control having been optimized, an oxygen bleaching takes place in a first delignification zone at low temperature, followed by a second delignification zone which is at a temperature which is 20–40 degrees higher. The aim was to obtain an improved yield and an improved viscosity, while retaining the same dwell time, in connection with industrial implementation.

In addition to SE,C,467.582, other variants of oxygen delignification in two stages have also been patented. SE,C, 505.147 presents a process in which the pulp should have a high pulp concentration, in the range of 25–40%, in the first stage and a concentration of 8–16% in the second stage, at the same time as the temperature in the second stage should be higher than, or the same as, the temperature in the first stage, in line with the temperature difference which is recommended in SE,C,467.582. The advantages of the solution in accordance with SE,C,505.147 are stated to be the possibilities of admixing more oxygen in the first high-consistency stage without the risk of channel formation but where, at the same time, unused quantities of oxygen can be bled off after the first stage for subsequent admixture in a second mixer prior to the second stage.

SE,C,505.141 presents yet another process, which is an attempt to circumvent SE,C,467.582, since that which it is sought to patent is stated to be that the temperature difference between the stages does not exceed 20 degrees, i.e. the lower suitable temperature difference which is patented in SE,C,467.582, but that nevertheless a temperature difference should exist. In addition to this, it is stated that a) the pressure should be higher in the first stage and b) that the dwell time is short in the first stage, i.e. of the order of magnitude of 10–30 minutes, and c) the dwell time in the second stage is longer, i.e. of the order of magnitude of 45–180 minutes.

A lecture entitled "Two-stage MC-oxygen delignification process and operating experience", which was given by Shinichiro Kondo, from the Technical Div.

Technical Dept. OJI PAPER CO. Ltd., at the 1992 Pan-Pacific Pulp & Paper Technology Conference ('99 PAN-PAC PPTC), Sept. 8–10, Sheraton Grande Tokyo Bay Hotel & Towers, presents a successful installation which involves two-stage oxygen delignification and which was constructed in 1986 in a plant in Tomakomai.

In this OJI PAPER plant in Tomakomai, the pulp was fed, at a pressure of 10 bar, to a first oxygen mixer (+steam), followed by an aftertreatment in a "preretention tube" (prereactor), with a dwell time of 10 minutes, in which the pulp pressure is reduced to a level of about 8–6 bar due to pipe losses, etc. After that, the pulp was fed to a second oxygen mixer, followed by an aftertreatment in a reactor at a pressure of 5–2 bar and with a dwell time of 60 minutes. At this point, it was stated that preference would have been given to having a "preretention tube" which would have given a dwell time of about 20 minutes but that it was not possible to achieve this due to lack of space. OJI PAPER stated that, by using this installation, they were successful in achieving an increase in kappa reduction for a lower cost in chemicals and also an improvement in pulp viscosity.

The greater part of the prior art has consequently been directed towards a higher pressure in the first reactor to a level of about 6(8)–10 bar. A pressure in the first reactor of up to 20 bar has even been discussed in some extreme applications. This entails the reactor spaces which are required for the first delignification zone having to be manufactured so as to cope with these high pressure levels, with the attendant requirement for substantial material thickness and/or good material qualities, resulting in an expensive installation.

Conventionally, these reactors are used as upright vessels, with the pulp flowing either upstream or downstream through the reactor. A problem then is that disparate reaction conditions arise through the reactor since the pressure changes during the process. When a vertical reactor having a height of 10 meters is used, a difference in pressure is then obtained simply due to the hydrostatic effect of 1 bar. As a result, the delignification process cannot be optimized equally well with regard to the pressure.

In pulp suspensions used in industrial manufacturing processes, there are large quantities of readily oxidizable constituents/structures which react even under modest process conditions. It is therefore advantageous to add oxygen in a first stage in quantities which are such that this relatively easily oxidized part of the pulp is allowed to oxidize/react first of all. Severe problems arise if an attempt is made to compensate for this by overadding oxygen since there is the imminent danger of channelling problems (as mentioned in the said SE,C,505.147).

OBJECT OF THE INVENTION

One object of the invention is to avoid the disadvantages of the prior art and to obtain an oxygen delignification of increased selectivity. The invention permits an optimal practical application of the theories regarding a first rapid phase and a second slower phase during the oxygen delignification process, where the optimal reaction conditions are different between the phases.

At the high hydroxide ion concentrations and high oxygen partial pressures which are conventionally employed in the first stage, the carbohydrates are attacked more than necessary, thereby impairing the quality of the pulp. A lower oxygen partial pressure, and preferably also a lower temperature, in the first stage than in the second stage decreases the rate of reaction for breaking down carbohydrates more than it decreases the rate of reaction for the delignification, thereby leading to an increased total selectivity on the pulp after the two stages.

Another object is to permit a simpler and cheaper process installation, in which it is possible to manufacture at least one pressure vessel in a first delignification zone using less robust material and/or a lower material quality which is suitable for a lower pressure class.

Yet another object is to permit an additional simpler and cheaper process installation in which the first pulp-conveying pump can be of a simple type which is dimensioned only for transporting the pulp through the first delignification zone. The process installation can also be effected in delignification plants in which the stations for adding oxygen are located very close to each other. Normally, an attempt is made to keep stations for adding oxygen and adding chemicals within a restricted area in order to limit working environment problems and discharge risks.

Yet another object is to make it possible also to use steam at moderate pressure, especially when there is a need to increase the temperature substantially between the first and second stages and where the pressure in the second stage is considerably higher than that the first stage. This makes it possible to convert existing single-vessel delignification systems where, with the previously known technique for converting to a two-stage design, a limitation has been that the prevailing pressure in the plant's steam grid has not enabled a sufficiently large quantity of steam to be admixed in the pulp in order to achieve the desired temperature in the second delignification stage.

Yet another object is to optimize the mixing process in each position such that only that quantity of oxygen is added which is consumed in the subsequent delignification zone. This makes it possible to dispense with bleeding systems for overshooting quantities of oxygen at the same time as it is possible to reduce the total consumption of oxygen, thereby reducing the operating costs for the operator of the fibre line and thus shortening the pay-off time.

Yet another object is to increase, in an oxygen delignification system having a given total volume of the first and second stages, a so-called H factor by operating the first stage for a short time at a low temperature and the second stage for a longer time at a higher temperature. When, for example, carrying out conversions of existing single-vessel oxygen delignification stages, a simple conversion, with a smaller prereactor and a modest increase in the reaction temperature in the existing reactor, can increase the H factor and at the same time improve the selectivity over the oxygen stages.

The invention is described in more detail with reference to the figures in accordance with the following figure list.

FIGURE LIST

Figure 2:
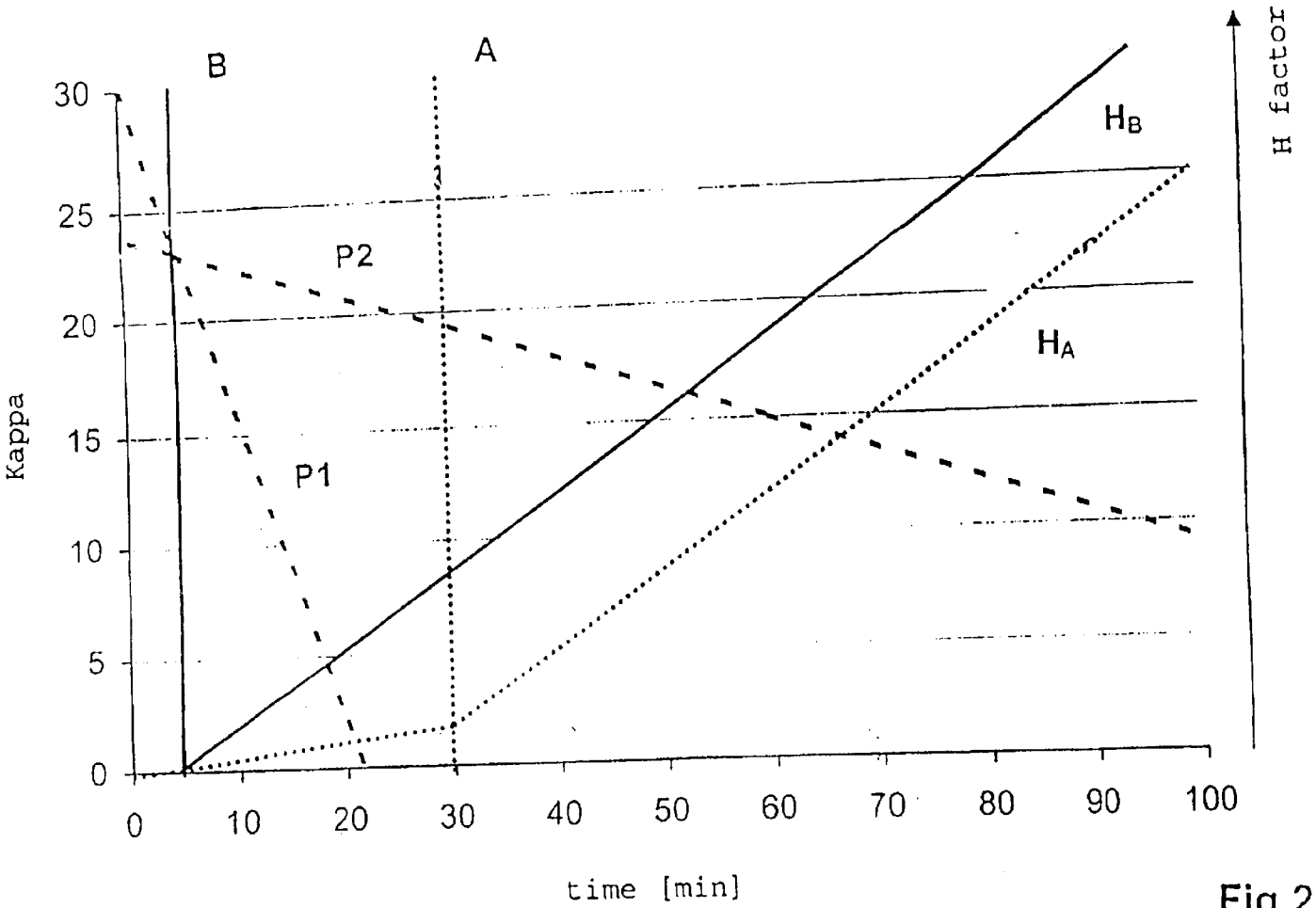
Figure 3:
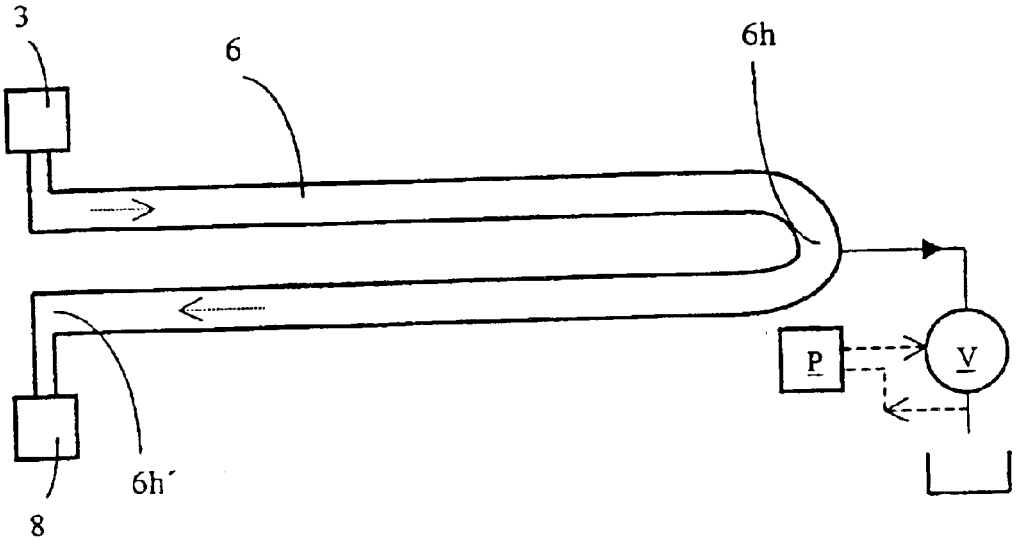

FIG. 1 shows a system for oxygen delignification in two stages in accordance with the invention; AND FIG. 2 diagrammatically shows the kinetics of oxygen delignification and the advantages which are gained relative to the prior art with regard to reduction in kappa number and an increased H factor, FIG. 3 shows an advantageous embodiment with a U-shaped first reaction stage between the first agitating mixer and the subsequent static mixer.

DESCRIPTION OF EMBODIMENT EXAMPLES

FIG. 1 shows an installation, according to the invention, of a system in an existing plant in which the oxygen delignification process required upgrading.

An existing first MC pump 1 (MC=medium consistency, typically a pulp consistency of 8–18%) is connected to a tipping chute 2 for forwarding to an existing first MC mixer 3. An admixture of chemicals, chiefly oxygen, takes place in the first MC mixer 3, after which the pulp was, in the existing system, fed to an oxygen reactor 10. The first mixer 3 is a so-called dynamic mixer, in which a motor-driven rotor agitates the pulp in at least one narrow fluidizing gap. The dynamic mixer is preferably a mixer type which corresponds to that presented in US433920, in which a first cylindrical fluidizing zone is formed between the rotor and the housing and a second fluidizing zone is formed between a radially directed rotor part and the housing, which mixer is hereby introduced as a reference. A mechanical agitation is required in order to obtain a uniform admixture of the chemical charge in question throughout the whole of the pulp suspension with the aim of ensuring that the pulp is bleached/treated uniformly throughout the whole of its volume.

The combination of a first MC pump 1 closely followed by an MC mixer 3 can be termed a "perfect pair". This is the case since the pump primarily pressurizes the pulp flow to a given degree, thereby facilitating a finely divided supply of the oxygen to the MC mixer which follows directly thereafter.

In accordance with the invention, an upgrading of the oxygen delignification process is achieved by introducing a first delignification zone 6, followed by a non-rotating/mechanically agitating mixer 8 for increasing the temperature by means of adding steam, followed by a second MC pump 4 and a second MC mixer 5, which mixer 5 acts directly after the pump 4.

The static mixer 8 is preferably of a construction as has been presented in SE,C,512.192 (=PCT/SE00/00137), in which steam is conducted in, as thin jets, through a number of holes which are uniformly distributed over the periphery of a pulp-conveying pipe, which mixer is hereby introduced as a reference.

The system is assembled such that the coupling pipe 6 forms a first delignification zone between the outlet of the first MC mixer and the inlet of the non-rotating mixer, which zone give rise to a dwell time RT Of 2–20 minutes, preferably 2–10 minutes, and even more advantageously 3–6 minutes. The second MC pump 4 is controlled such that the resulting pressure in the delignification zone 6 is preferably in the interval 0–8 bar, preferably 2–8 bar, and even more advantageously 3–6 bar. Preferably, the second pump 4 is controlled by means of its rotational speed being controlled by a control system PC in dependence on the pressure which prevails, and is detected, in the first delignification zone 6. This first delignification zone should have an extension length which is the main horizontal. Expediently, the coupling pipe can be drawn in the form of a U-shaped loop, in which the highest point of the loop is constituted by the bottom of the U and in which the height in relation to the connection points of the loop is determined in such a way that the gas collects at the bottom of the U, preferably less than 0.5 m, and even more advantageously less than 0.1 m, above the highest of the connection points, where means for separating off the gas are expediently present. The connection of the loop to the respective mixers is effected such that the mixers end up at essentially the same height, at least a height difference of less than 2 meters, expediently a height difference of less than 1.0 m, and preferably less than 0.1 m. This results in a controlled pressure profile through the whole of the delignification zone, thereby further improving the prerequisites for exploiting the kinetics of oxygen delignification in an optimal manner and thereby achieving selective oxygen delignification.

The temperature in the first delignification zone can be kept low, preferably at the level which the system allows without adding steam, but preferably with the pulp entering the first delignification zone being at a temperature of about 85° C., +10° C.

The non-rotating mixer 8 is connected in after the first delignification zone, as is then the second MC pump 4, followed by the second MC mixer 5. This second "perfect pair" combination is controlled such that the resulting pressure in the oxygen reactor 10, which reactor forms a second delignification zone, reaches a level of at least 3 bars overpressure at the top of the reactor. The pressure in the second MC mixer should be at least 4 bar higher than that in the first MC mixer; alternatively, the increase in pressure in the second pump should reach 4 bar. In connection with practical implementation in conventional oxygen stages, an initial pressure is obtained within the interval 8–12 bar, corresponding to the pressure at the inlet to the reactor.

In accordance with the invention, the temperature of the pulp in the second delignification zone is increased by supplying steam to the non-rotating mixer directly after the first delignification zone and before the pressure-increasing pump 4 comes into play. The steam supply is expediently controlled using a control system TC, which comprises a control valve V on the line 7 for the steam supply and a feeding-back measurement of the temperature of the pulp which is leaving the mixer. The temperature is expediently raised to a level of 100° C.±10° C., but preferably at least 5° C. higher than the temperature in the first delignification zone. As a result of the steam being supplied before the high pressure, which is required for the final phase of the delignification, is imparted to the pulp:

- a higher temperature can be obtained
- the available steam can be at a lower pressure
- the mixers for admixing the oxygen do not need to be burdened with supplying steam as well, something which would otherwise reduce their efficiency.

The volume of the second delignification zone, i.e. the second reactor, is expediently designed such that it is at least 10 times greater than the volume of the first delignification zone, i.e. a retention time of at least 20–200 minutes, preferably 20–100 minutes, and even more advantageously within the range 50–90 minutes.

FIG. 2 diagrammatically shows the kinetics of the oxygen delignification and the advantages with regard to the principles of kappa number reduction which are obtained relative to the prior art.

Curve P1 shows the principle of a reaction course during the initial phase of the delignification. This part of the delignification proceeds relatively rapidly and is typically essentially complete after a good 20 minutes.

However, after a relatively short time, typically only 5–10 minutes, the final phase P2 of the delignification takes over and begins to dominate as far as the resulting delignification of the pulp is concerned. A typical subdivision of the delignification into two stages in accordance with the prior art is shown at line A, with stage 1 being to the left of the line A and stage 2 being to the right of the line A. It follows from this that two different dominating processes, i.e. the initial phase of the delignification on the one hand, but also its final phase, actually take place in stage 1. It can be concluded from this that it becomes impossible to optimize the process conditions in stage 1 for both these delignification phases.

Instead, a subdivision of the delignification into two stages in accordance with the invention is shown at the line B, with stage 1 being to the left of the line B and stage 2 being to the right of the line B. This makes it possible to optimize each stage for the process which dominates in the stage. The curve HA shows the temperature integral plotted against time (H factor) which is typically obtained when implementing a delignification process in two stages in accordance with the prior art, corresponding to the line A.

As can be seen from the figure, it is possible to use the stage subdivision in accordance with the invention to obtain an H factor which is higher than that which is typically obtained in current installations. This can be done without foregoing demands for high selectivity over the oxygen delignification system.

FIG. 3 shows the most advantageous embodiment of the first reaction stage 6, with this reaction stage being seen from above in FIG. 3 and with a U-shaped pipe loop forming the whole of the reaction stage. The U shape in which the pipe is drawn provides the lowest possible flow resistance/pressure drop at the same time as the pipe loop can be laid essentially in the same horizontal plane. In certain installations, there can be a risk of gas separating during transport in the pipe loop; for this reason, the loop can be installed with a highest point 6*h* or 6*h*' somewhere on the pipe loop. A device for extracting accumulated gas can then be arranged in conjunction with such a highest point, where the gases tend to accumulate. The figure shows a valve V which can be opened and drain off accumulated gas. The valve can be controlled using control equipment which opens the valve in dependence on some suitable process parameter, for example operating time, flow, etc., and closes it when pulp fibres are detected in the flow through the valve. While the figures show the pipe loop having essentially the same pipe dimensions throughout the whole of the drawn loop, the dimensions of the actual pipe connections from the mixers 3 and 8, respectively, can be less than those of the actual pipe loop in the reaction stage.

Alternatively, the reduction in area in conjunction with the output from the pipe bend to the mixer 8 can be used to generate an increase in the speed of the pulp and thus induce an injector effect on the accumulated gas when the highest point 6*h*' is located at the outlet.

The invention also opens up ways of upgrading, for a small investment, an existing 1-stage process, which is of relatively low selectivity, to a 2-stage system of superior selectivity, with this being achieved without having to build a new large reactor or even two such reactors. According to the invention, the initial phase of the oxygen delignification is dealt with in the prereactor, after which the temperature in the existing reactor can, if so required, even be raised in association with the conversion, and an increased H factor can in this way be combined with increased selectivity.

The invention can be modified in a number of ways within the scope of the inventive concept. For example, the first delignification zone can consist of a pipe which is drawn to form an S shape or a W shape. Further delignification zones, or intermediate washing/leaching or extraction of the pulp, can be introduced between the first and second delignification zones according to the invention. For example, a third "perfect pair" combination, i.e. a pump with a mixer following it, can be arranged between the zones. The essential point is that the first delignification zone is characterized by a lower pressure, a short dwell time and a moderate temperature, and that the concluding, final delignification zone is characterized by a higher pressure (a pressure which is at least 4 bar higher than that of the first zone), a longer dwell time (a dwell time which is at least 10 times longer than that in the first zone) and an increased temperature (a temperature which is preferably at least 5 degrees higher than that in the first zone).

Where appropriate, it should be possible to charge a first mixer, or an intermediate mixer in a third "perfect pair" combination, at least partially with oxygen which is blown off from the reactor 10. The economic basis for such a recovery of oxygen is poor since the cost of oxygen is relatively low.

In order to guarantee optimal process conditions, one or other, preferably the second, or both, of the MC pumps can be rotation speed-controlled in dependence on the pressure in the first delignification zone.

The invention can also be modified by the further addition of a number of different chemicals which are selected and suitable for the specific fibre line and the pulp quality in question, such as agents for protecting cellulose, for example $MgSO_4$, or other alkaline earth metal ions or compounds thereof;

additions of complexing agents which are made prior to adding oxygen, with subsequent removal of precipitated metals, where appropriate;

chlorine dioxide;

hydrogen peroxide or organic or inorganic peracids or salts thereof;

free-radical capturing agents, such as alcohols, ketones, aldehydes or organic acids; and carbon dioxide or other additives.

Where appropriate, it should also be possible to degas exhaust gases (residual gases) in immediate conjunction with the second pump, preferably by means of the pump being provided with internal degassing, preferably a pump termed a "degassing pump".

What is claimed is:

1. A system for the oxygen delignification of pulp having a lignocellulose-containing material having a mean concentration of 8%–18% pulp consistency, comprising:

a pump for enabling movement of the pulp;

a mixer in operative engagement with the pump for enabling mixing of the pulp and mixing of oxygen;

a first and a second reaction stage for oxygen delignification of the pulp, the first reaction stage having a first reactor for permitting a first dwell time of 2–20 minutes, the second reactor stage having a second reactor for permitting a second dwell time of at least 20–200 minutes;

first addition means in fluid communication with the first reaction stage for adding chemicals to the system at a first position prior to the first reaction stage;

second addition means in fluid communication with the second reaction stage for adding chemicals at a second position after the first reaction stage and prior to the second reaction stage;

third addition means for adding oxygen;

the first reaction stage having a pipe loop disposed between the first and second addition means, the pipe loop having a length; and the first addition means being disposed at a distance from the second addition means that is shorter than the length of the pipe loop, the pipe loop being arranged to extend essentially in a horizontal plane.

2. The system according to claim 1 wherein the chemicals are mainly oxygen substances.

3. The system according to claim 1 wherein a first volume of the first reactor permits a first dwell time of between 2–10 minutes.

4. The system according to claim 3 wherein the first volume permit a first dwell-time of between 3–6 minutes.

5. The system according to claim 1 wherein a second volume of the second reactor permits a second dwell time of between 20–100 minutes.

6. The system according to claim 5 wherein the second volume permit a second dwell time of between 50–90 minutes.

7. The system according to claim 1 wherein the length of the pipe loop is at least 20 meters.

8. The system according to claim 1 wherein the length of the pipe loop is at least 30–50 meters.

9. The system according to claim 1 wherein the first addition means is disposed at a distance from the second addition means that is at least 10 meters shorter than the length of the pipe loop.

10. The system according to claim 1 wherein the pipe loop is U-shaped.

11. The system according to claim 1 wherein the pipe loop has a highest point that is located at a bend of the U-shaped pipe loop.

12. The system according to claim 11 wherein the highest point is located in a downstream position of a flow of the pulp.

13. The system according to claim 1 wherein the pipe loop has a lowest point and a highest point, the highest point is less than two meters above the lowest point.

14. The system according to claim 13 wherein the highest point is between 0.2–1 meters above the lowest point.

15. The system according to claim 13 wherein means for degassing is disposed at the highest point.

16. The system according to claim 15 wherein the means for degassing has a controllable degassing valve from which accumulated air or residual gases are drawn off from the pipe loop.

17. The system according to claim 15 wherein the means for degassing comprises a local reduction segment to impart an increased speed flow of the pulp.

18. The system according to claim 1 wherein the first addition means comprises a first pump that is arranged to pump the pulp to a first mixer in fluid communication with the first pump.

19. The system according to claim 1 wherein the second addition means comprises a second static mixes, a second pump in fluid communication with the second static mixer and a third mixer in fluid communication with the second pump.

20. The system according to claim 1 wherein the first reaction stage has a substantially constant pressure.

* * * * *